US007690374B2

(12) United States Patent
Lee et al.

(10) Patent No.: US 7,690,374 B2
(45) Date of Patent: Apr. 6, 2010

(54) GAS RADIATION OVEN RANGE

(75) Inventors: Dae-Rae Lee, Gyungsangnam-Do (KR); In-Gyu Kim, Gyungsangnam-Do (KR); Dae-Hee Jung, Gyungsangnam-Do (KR); Sug-Moon Choung, Gyungsangnam-Do (KR); Yang Ho Kim, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 466 days.

(21) Appl. No.: 10/536,395

(22) PCT Filed: Nov. 29, 2002

(86) PCT No.: PCT/KR02/02245

§ 371 (c)(1),
(2), (4) Date: May 26, 2005

(87) PCT Pub. No.: WO2004/051145

PCT Pub. Date: Jun. 17, 2004

(65) Prior Publication Data

US 2006/0048767 A1 Mar. 9, 2006

(51) Int. Cl.
*F24C 3/00* (2006.01)

(52) U.S. Cl. ..... 126/39 J; 126/39 R

(58) Field of Classification Search ..... 126/39 K, 126/39 J, 39 N, 39 H, 39 B, 214 R, 214 A, 126/214 D, 212, 220, 215, 216, 214 B, 214 C, 126/39 R See application file for complete search history.

(56) References Cited

U.S. PATENT DOCUMENTS 3,468,298 A * 9/1969 Dorwin, Jr. et al. ..... 126/39 J
3,494,350 A * 2/1970 Perl ..... 126/39 J
3,555,995 A * 1/1971 Berger ..... 99/446
3,586,825 A * 6/1971 Hurley ..... 219/452.12
3,596,650 A * 8/1971 Cerola ..... 126/17
3,633,562 A * 1/1972 Morse et al. ..... 126/39 J
3,663,798 A * 5/1972 Speidel et al. ..... 219/452.12
3,698,378 A * 10/1972 Rosenberg et al. ..... 126/39 R
3,785,364 A * 1/1974 Reid et al. ..... 126/39 J
3,797,375 A * 3/1974 Cerola ..... 99/340

(Continued)

FOREIGN PATENT DOCUMENTS

DE 19545842 C1 10/1996

(Continued)

*Primary Examiner*—Kenneth B Rinehart
*Assistant Examiner*—Jorge Pereiro
(74) *Attorney, Agent, or Firm*—Birch, Stewart, Kolasch & Birch, LLP

(57) ABSTRACT

A gas radiation oven range including an outer case (10) which is formed with an upper side opened, having an internal space, a ceramic glass (20) which is covered and combined with an upper end of the outer case (10), a plurality of burner housings (300) which are combined to be contacted with a lower surface of the ceramic glass (20), forms an exhaust passage (F) with the lower surface of the ceramic glass (20), and is integrally combined with a plurality of ports with different sizes, a radiant burner (40) which is combined with a side surface of the respective burner housings (300), for generating a radiant wave, combusting mixed gas and a shared discharge unit which is positioned among the burner housings (300) and combined to be connected to respective exhaust passages (F) which are formed at a side portion of the burner housings (300).

10 Claims, 6 Drawing Sheets

U.S. PATENT DOCUMENTS 4,020,821 A * 5/1977 Reid et al. ..... 126/39 E
4,130,104 A * 12/1978 Kristen et al. ..... 126/39 J
4,201,184 A * 5/1980 Scheidler et al. ..... 126/39 J
4,375,802 A * 3/1983 Wallasvaara ..... 126/21 A
4,431,892 A * 2/1984 White ..... 219/623
4,549,052 A * 10/1985 Simon ..... 219/623
4,551,600 A * 11/1985 Miyagawa et al. ..... 219/623
4,580,550 A * 4/1986 Kristen et al. ..... 126/39 J
4,724,823 A * 2/1988 Simpson ..... 126/39 R
4,951,646 A * 8/1990 Diekmann et al. ..... 126/39 J
4,962,694 A * 10/1990 Graver ..... 99/339
5,119,802 A * 6/1992 Cherry et al. ..... 126/39 E
5,139,007 A * 8/1992 Bertomeu ..... 126/39 J
5,209,217 A * 5/1993 Beach et al. ..... 126/39 R
5,246,365 A * 9/1993 Himmel et al. ..... 431/263
5,251,609 A * 10/1993 Thibault et al. ..... 126/39 J
5,301,653 A * 4/1994 Gerdes et al. ..... 126/39 E
5,400,765 A * 3/1995 Goldstein et al. ..... 126/39 J
5,406,932 A * 4/1995 Joseph et al. ..... 126/39 K
5,509,403 A * 4/1996 Kahlke et al. ..... 126/39 E
5,524,605 A * 6/1996 Niwa ..... 126/39 J
5,568,804 A * 10/1996 Joseph et al. ..... 126/39 K
5,742,031 A * 4/1998 Kelly et al. ..... 219/446.1
5,979,429 A * 11/1999 Schultheis et al. ..... 126/39 G
6,067,980 A * 5/2000 Kahlke et al. ..... 126/214 R
6,076,517 A * 6/2000 Kahlke et al. ..... 126/39 J
6,230,701 B1 * 5/2001 Schultheis et al. ..... 126/39 J
6,293,276 B1 * 9/2001 Owens et al. ..... 126/299 D
6,349,714 B1 * 2/2002 Hurley et al. ..... 126/39 J
6,807,962 B2 * 10/2004 Taplan et al. ..... 126/39 B
6,830,045 B2 * 12/2004 Brock et al. ..... 126/19 R
6,966,315 B2 * 11/2005 Pickering ..... 126/39 E
2002/0164553 A1 * 11/2002 Distaso et al. ..... 431/280
2004/0060552 A1 * 4/2004 Yamada et al. ..... 126/39 K
2006/0070616 A1 * 4/2006 Lee et al. ..... 126/299 D
2006/0144388 A1 * 7/2006 Hosoi et al. ..... 126/214 A
2006/0254574 A1 * 11/2006 Lee et al. ..... 126/39 R

FOREIGN PATENT DOCUMENTS

KR 2002056337 A * 7/2002

* cited by examiner

GAS RADIATION OVEN RANGE

TECHNICAL FIELD

The present invention relates to a gas radiation oven range and particularly, to a gas radiation oven range, capable of discharging combustion gas and convection heat which is generated when mixed gas is burned in a gas radiation oven range having two or more radiant burners and improving productivity.

BACKGROUND ART

Generally, a gas radiation oven range is a device for cooking food by using radiation heat which is radiated from a heated radiator by heating the radiator.

FIG. 1 is a view showing an embodiment of a conventional gas radiation oven range and FIG. 2 is a partial longitudinal sectional view showing a structure of the conventional gas radiation oven range. As shown in the drawings, the gas radiation oven range comprising an outer case 10 which is formed to have an internal space with the upper side opened, ceramic glass 20 which is covered and combined with the upper end of the outer case 10, for placing foodstuffs therein, a burner housing 30 which is combined and contacted with the lower surface of the ceramic glass 20, for forming an exhaust passage F with the lower substrate of the ceramic glass 20 in a predetermined shape, and a radiant burner 40 which is combined with a side surface of the burner housing 30, for generating a radiant wave combusting mixed gas.

The outer case 10 is formed in a hexahedral shape with the upper side opened, an air inlet duct 11 is formed on the front surface of the case, and an exhaust duct 12 is formed on the rear surface of the hexahedron.

The ceramic glass 20 is formed to have an area and thickness which can cover the upper end of the outer case 10 and formed with materials through which radiant wave which is generated in the radiant burner 40 can penetrate.

On the upper side surface of the ceramic glass 20, a cooking area A is printed so that foodstuffs can be positioned at a position where radiant wave which is radiated from the radiant burner 40 is penetrated.

The burner housing 30 comprising a lower plate portion 31 which is formed to have a predetermined width and length, a side plate portion 32 which is respectively formed being bent and extended in the vertical direction on the both side surfaces of the lower plate portion 31, a connecting plate portion 33 which is formed being extended and bent to connect the both side plate portions 32 to a side end of the lower plate portion 31, a combining plate portion 34 which formed being extended and bent in the parallel direction from the ends of the both side plate portion 32 and connecting plate portion 33 respectively, having a predetermined area, and a mounting hole 35 which is penetrated and formed so that the radiant burner 40 can be mounted on a side surface of the lower plate portion 31 to be positioned at the side of the air inlet duct 11 of the outer case 10.

The connecting plate portion 33 of the burner housing 30 is positioned on the front surface of the outer case 10 and the opened part at the opposite side is positioned at the rear surface of the outer case 10.

The combining plate portion 34 is contacted and combined with the lower surface of the ceramic glass 20, and accordingly, the combining plate surface 34 forms an exhaust passage F for exhausting combustion gas and convection heat with the lower plate portion 31 and both side plate portions 32 of the burner housing 30, and the lower surface of the ceramic glass 20.

In the radiant burner 40, a burner head 41 where a mixing room M is formed, is fixed and combined to be positioned in the mounting hole 35 of the burner housing 30, and a mixing gas tube 44 is combined to a surface of the burner head 41. In addition, a burner mat 42 which is a radiator for radiating a radiant wave is fixed and combined to the upper side of the burner head 41 so that the burner mat 42 can cover the mixing room M of the burner head 41 by heating the mixed gas as the gas in the mixing room M is discharged and combusted.

A ignition and inflammation detecting unit 43 for igniting the mixed gas which is outflowed through the burner mat 42 and detecting the combusting state of the gas, is combined to the lower plate portion 31 of the burner housing 30 near from the burner mat 42.

A fan housing 45 in which a blast fan 46 and fan motor 47 are mounted, is combined to be connected with the mixing gas tube 44.

On the other hand, the radiant burner can be composed of a plurality of assemblies formed by combining the burner housing 30 and radiant burner 40, according to the usage and size.

Hereinafter, the operation of the above gas radiation oven range will be described as follows.

Firstly, when a gas radiation oven range is operated by putting a cooking vessel 50 in which foodstuffs are positioned in the cooking region of the ceramic glass 20, external air is sucked through the inlet duct 11 by rotation of the blast fan 46. The air is flowed into the mixed gas tube 44 and simultaneously, gas which is additionally supplied is supplied to the mixed gas tube 44 to be mixed with the air and the gas mixed with the air is outflowed through the burner mat 42 and combusted by being ignited by the ignition flame which is generated in the ignition and inflammation detecting unit 43.

At this time, as the mixed gas is outflowed through the burner mat 42 and combusted, the burner mat 42 is heated and a radiant wave is radiated from the burner mat 42. The radiant wave which is radiated from the burner mat 42 penetrates the ceramic glass 20, thus to cook the foodstuffs which are contained in the cooking vessel 50 by heating the vessel.

The combustion gas and convection heat which are generated as the mixed gas is combusted, flow along the exhaust passage F which is formed by the ceramic glass 20 and burner housing 30 at a predetermined flowrate and discharged to the outside of the gas radiation oven range through the exhaust duct 12 which is formed on the rear surface of the outer case 10.

On the other hand, the above conventional gas radiation oven range uses two burners and accordingly, a structure of respective component parts will be disclosed.

However, independent exhaust of respective burner housings under the condition that the size of the burners is different, makes controlling of the amount of exhaust difficult, and there can be occurred losses of cost and time as many components parts are assembled in manufacturing the burner.

Also, in families or professional places such as a hotel where the gas radiation oven range is used, burners with various heating power are needed according to the foodstuffs and simultaneously, occasions that various materials are cooked at the same time are often occurred. Therefore, small numbers of ports could not satisfy the above requirements.

Also, increase of the productivity in manufacturing the product is very important for manufacturing the gas radiation oven range as well as all industrial products. The conventional composition containing many component parts could not improve the productivity.

That is, the conventional gas radiation oven range having just two ports and respectively independent exhausting structure could not satisfy requirements of the present industries.

DISCLOSURE OF THE INVENTION

Therefore, it is an object of the present invention to provide a gas radiation oven range which can discharge combustion gas and convection heat which is generated as mixed gas is combusted in a gas radiation oven range which includes two or more radiant burners efficiently, and improve productivity.

Also, it is an object of the present invention to provide a gas radiation oven range which can satisfy requirements of the present industries that need a plurality of ports for various cooking.

To achieve these objects, there is provided a gas radiation oven range, including an outer case whose upper side is opened and which is formed to have a predetermined internal space, a ceramic glass which is covered and combined at the upper end of the outer case and in which cooked material is positioned, a burner housing which is combined to be contacted on the lower surface of the ceramic glass and forms an exhaust passage together with the lower surface of the ceramic glass and to which a plurality of burners are combined in a dual structure, a plurality of radiant burners which are combined with one side surface of the burner housing and generate a radiant wave, combusting mixed gas and a shared discharge unit which is extended to the rear surface of the outer case so that the exhaust gas, which is generated respectively from the plurality of radiant burners, is discharged to the exhaust duct which is positioned at the rear side of the outer case, as it is positioned among the plurality of radiant burners and combined to be connected with the respective exhaust passages which are formed in a side portion of the burner housing.

To achieve these objects, there is provided a gas radiation oven range, including an outer case which is formed with an upper side opened, having an internal space, a ceramic glass which is covered and combined with an upper end of the outer case, a first burner housing which is combined and contacted with a lower surface of the ceramic glass, forms an exhaust passage with the lower surface of the ceramic glass, and is integrally combined with a plurality of large ports in a dual structure, a second burner housing in which respective medium ports are formed at a side independently from the first burner housing in which the plurality of large ports are formed, and third burner housing in which a small port is formed, a radiant burner which is combined with a side surface of the respective burner housings, for generating a radiant wave, combusting mixed gas and a shared discharge unit which is positioned among the plurality of large ports which are integrally formed with the first burner housing and combined to be connected to respective exhaust passages which are formed at a side portion of the large ports, for discharging exhaust gas which is generated from the plurality of radiant burners respectively, to the exhaust duct side which is positioned at the rear side of the outer case.

To achieve these objects, there is provided a gas radiation oven range, including an outer case which is formed with an upper side opened, having an internal space, a ceramic glass which is covered and combined with an upper end of the outer case and in which cooked material is positioned, a first burner housing which is combined and contacted with a lower surface of the ceramic glass, forms an exhaust passage with the lower surface of the ceramic glass, and is integrally combined with a plurality of large ports in a dual structure, a fourth burner housing in which a plurality of medium ports and small ports which are independent from the first burner housing which is integrally formed with the plurality of large ports, a radiant burner which is combined with a side surface of the respective burner housings, for generating a radiant wave, combusting mixed gas and a shared discharge unit which is positioned among the plurality of burner housings and combined to be connected to respective exhaust passages which are formed at a side portion of the burner housings, for discharging exhaust gas which is generated from the plurality of radiant burners respectively, to the exhaust duct side which is positioned at the rear side of the outer case.

To achieve these objects, there is provided a gas radiation oven range, including an outer case which is formed with an upper side opened, having an internal space, a ceramic glass which is covered and combined with an upper end of the outer case, a fifth burner housing which is combined and contacted with a lower surface of the ceramic glass, forms an exhaust passage with the lower surface of the ceramic glass, and is integrally combined with one or more large ports and one or more medium ports in a dual structure, a sixth burner housing in which one or more large ports and one or more small ports which are positioned at the side portion independently from the fifth burner housing, are integrally formed, a radiant burner which is combined with a side surface of the fifth and sixth burner housings, for generating a radiant wave, combusting mixed gas and a shared discharge unit which is positioned among the fifth and sixth burner housings and combined to be connected to respective exhaust passages which are formed at a side portion of the burner housings, for discharging exhaust gas which is generated from the plurality of radiant burners respectively, to the exhaust duct side which is positioned at the rear side of the outer case.

To achieve these objects, there is provided a gas radiation oven range, including an outer case which is formed with an upper side opened, having an internal space, a ceramic glass which is covered and combined with an upper end of the outer case, burner housings which are combined to be contacted with a lower surface of the ceramic glass, forms an exhaust passage with the lower surface of the ceramic glass, and is integrally combined with a plurality of ports with different sizes, another burner housings to which ports with different sizes are integrally combined and which is positioned at a side portion independently from the above burner housing, a radiant burner which is combined with a side surface of the respective burner housings, for generating a radiant wave, combusting mixed gas and a shared discharge unit which is positioned among the burner housings and combined to be connected to respective exhaust passages which are formed at a side portion of the burner housings, for discharging exhaust gas which is generated from the plurality of radiant burners respectively, to the exhaust duct side which is positioned at the rear side of the outer case.

MODES FOR CARRYING OUT THE PREFERRED EMBODIMENTS

Hereinafter, the gas radiation oven range in accordance with the present invention will be described in detail with reference to the accompanied drawings.

Figure 1:
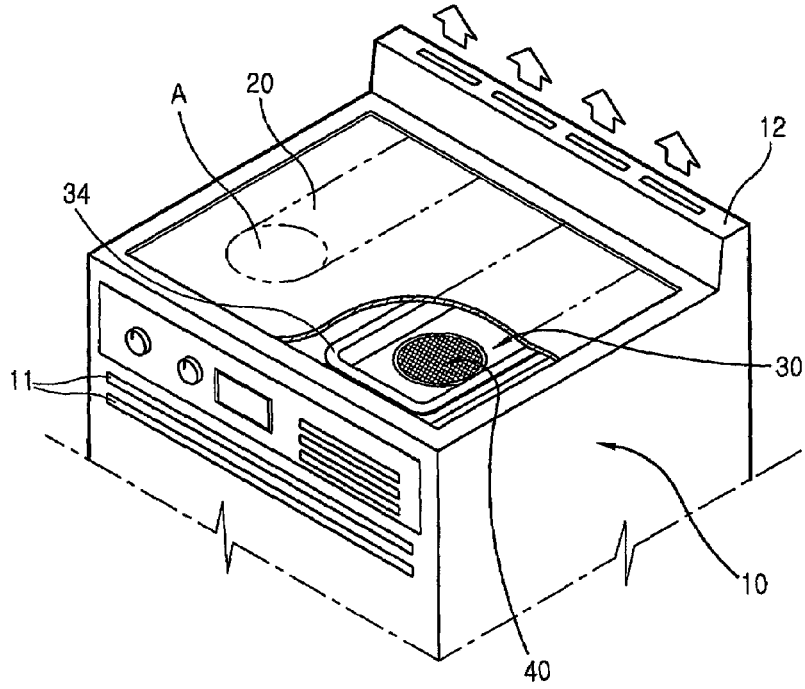
FIG. 1 is a perspective view showing an embodiment of a conventional gas radiation oven range.
Figure 2:
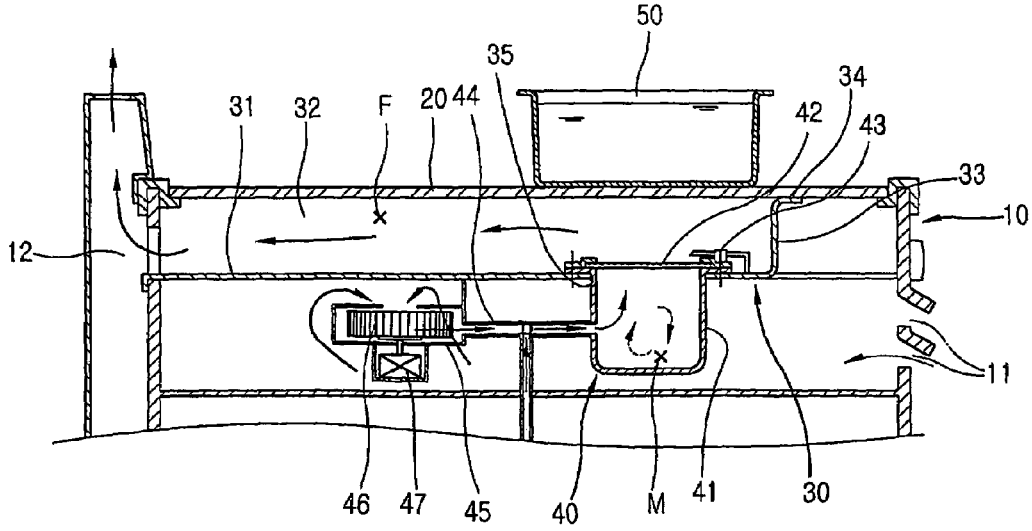
FIG. 2 is a partial longitudinal sectional view showing a structure of the conventional gas radiation oven range.
Figure 3:
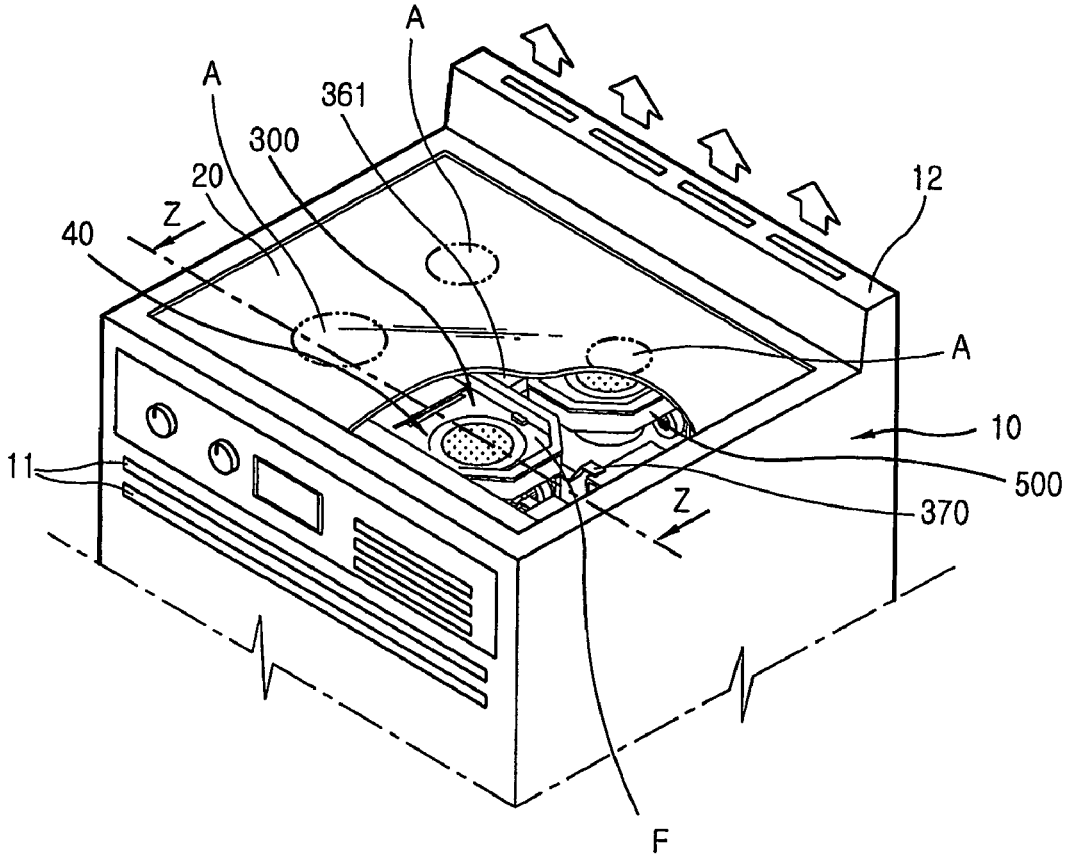
FIG. 3 is a perspective view showing a first embodiment of a structure of a gas radiation oven range and the cooking system in accordance with the present invention.
Figure 4:
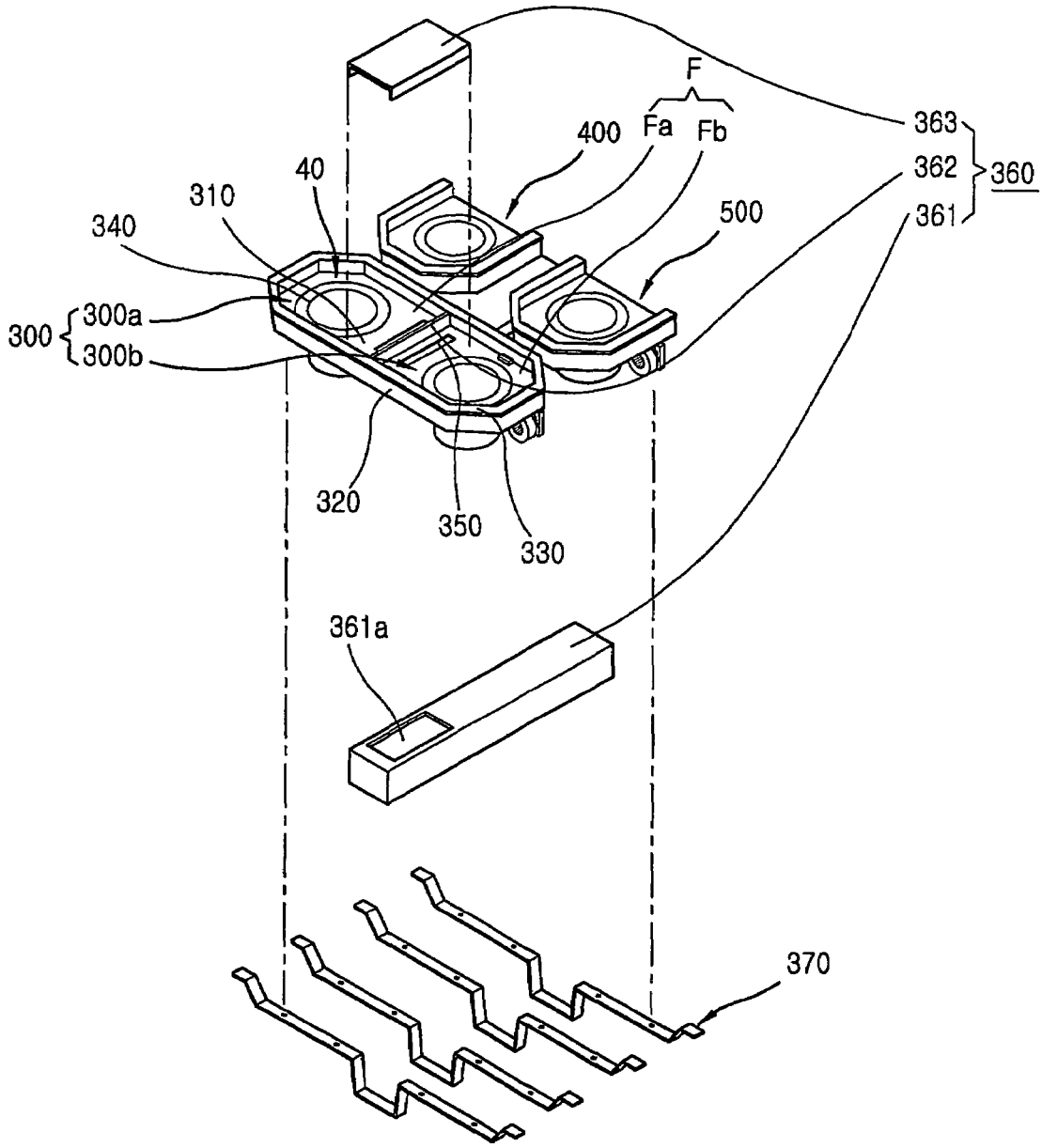
FIG. 4 is an exploded perspective view showing a structure of the gas radiation oven range in accordance with the present invention.
Figure 5:
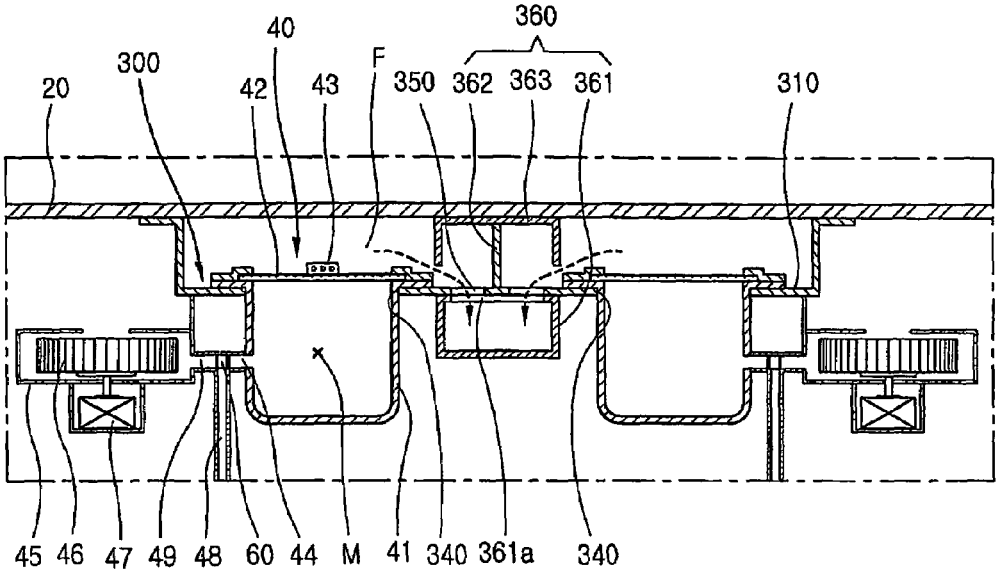
FIG. 5 is a partial longitudinal sectional view showing a structure of the gas radiation oven range in accordance with the present invention.

FIG. 3 is a perspective view showing a first embodiment of a structure of a gas radiation oven range and the cooking system in accordance with the present invention, FIG. 4 is an exploded perspective view showing a structure of the gas radiation oven range in accordance with the present invention, and FIG. 5 is a partial longitudinal sectional view showing a structure of the gas radiation oven range in accordance with the present invention.

Hereinafter, the gas radiation oven range in accordance with the present invention will be described.

First, as shown in FIGS. 3, 4 and 5, the structure of the gas radiation oven range in accordance with the present invention includes an outer case 10 which is formed to have an internal space with the upper side opened, ceramic glass 20 which is covered and combined with the upper end of the outer case 10, for placing foodstuffs therein, a first burner housing 300 which is combined and contacted with the lower surface of the ceramic glass 20, for forming an exhaust passage F with the lower substrate of the ceramic glass 20 in a predetermined shape, a radiant burner 40 which is combined with a side surface of the first burner housing 300, for generating a radiant wave combusting mixed gas, and a shared discharge unit 360 which is positioned at the lower portion of the plurality of first burner housings 300, combined to be connected to the respective exhaust passage F and extended so that the exhaust gas, which is generated respectively from the plurality of radiant burners, is discharged to the exhaust duct 12 which is positioned at the rear side of the outer case 10.

The outer case 10 is formed in a hexahedral shape with an upper side opened, an air inlet duct 11 to which air is flowed is formed on the front surface of the outer case 10, and an exhaust duct 12 is positioned on the rear surface of the hexahedron.

The ceramic glass 20 is formed to have an area which can cover the upper end of the outer case 10 and a predetermined thickness and the ceramic glass 20 is formed with materials through which radiant wave generated from the radiant burner 40 can penetrate.

On the upper surface of the ceramic glass 20, a cooking area A is printed so that a cooked material can be positioned at a position where the radiant wave which is generated from the radiant burner penetrates.

As shown in FIGS. 4 and 5, the first burner housing 300 includes a lower plate portion 310 in a rectangular shape which is formed to have a predetermined width and length, a side plate portion 320 which is formed bent and extended in the vertical direction corresponding to a contour of the lower plate portion 310 along the circumference on the side surface of the lower plate portion 310, a combining surface portion 330 formed extended and bent in parallel in the direction of the outer circumference from the end of the side plate portion 320 having a predetermined area, a plurality of mounting holes 340 which are penetrated and formed on both sides of the rectangular lower plate portion 310 so that the radiant burner 40 can be mounted and a plurality of exhaust through holes 350 which are formed corresponding to the mounting holes 340 in the center portion of the lower plate portion 310.

As the combining plate portion 330 is contacted and combined to a lower surface of the ceramic glass 20, the combining plate portion 330 forms an exhaust passage F for discharging combustion gas and convection heat together with the first burner housing 300, lower plate portion 310, side plate portion 320 and a lower surface of the ceramic glass 20.

Two or more mounting holes 340 are formed so that a large port having a predetermined diameter can be mounted.

On the other hand, the plurality of exhaust through holes 350 can be formed to face each other at the center portion of the first burner housing 300 correspondingly, and can be formed in a row to each other at the side portion of the first burner housing 300.

The shared exhaust duct 360 includes an exhaust stack 361 which is combined to be contacted on a side surface of the first burner housing and has a side surface in which a cut inflow hole 361*a* is formed, so that exhaust gas, which is discharged from a plurality of exhaust through holes 350 which are formed on one side surface of the first burner housing 300, can be received, a partition 362 which is combined with the lower plate portion 310 of the first burner housing 300 in the direction of a normal line, and respectively divides exhaust gas which is generated from a plurality of radiant burner formed on both sides of the burner housing 300 by dividing an exhaust passage Fa of the burner housing 300*a* of a side and exhaust passage Fb of the burner housing 300*b* of the other side and an exhaust cover 363 whose upper side is positioned to be contacted on the lower substrate of the ceramic glass 20 and whose lower side is combined to the partition 362, for preventing convection heat of the exhaust gas which is generated in the radiant burner 40 from being transferred to the ceramic glass 20.

The first burner housing 300 which is combined with the exhaust duct 360 is combined with a guide 370 which is bent corresponding to the shape and combined with the inner surface of the outer case 10.

The radiant burner 40 is fixed and combined so that a burner head 41 where a mixing room M is formed can be positioned in the mounting hole 340 of the first burner housing 300 and a mixing gas tube 44 is combined to a side surface of the burner head 41. A burner mat 42 which is a radiator for radiating a radiant wave is fixed and combined to the upper side of the burner head 41 so that the burner mat 42 can cover the mixing room M of the burner head 41 by heating the mixed gas as the gas in the mixing room M is discharged and combusted.

A ignition and inflammation detecting unit 43 for igniting the mixed gas which is outflowed through the burner mat 42 and detecting the combusting state of the gas, is combined to the lower plate portion 310 of the first burner housing 300 near from the burner mat 42.

Also, at the rear end portion of the mixing gas tube 44, gas supplying tube 48 and air supplying tube 49 are branched and connected, and a nozzle 60 is combined to an inner side of a position where the gas supplying tube 48 and air supplying tube 49 cross.

A fan housing 45 in which a blast fan 46 and fan motor 47 are mounted is combined to a rear end portion of the air supplying tube 49.

On the other hand, the gas radiation oven range can be composed of a plurality of assemblies which are combined with the first burner housing 300 and radiant burner 40 according to the usage and size.

Figure 6:
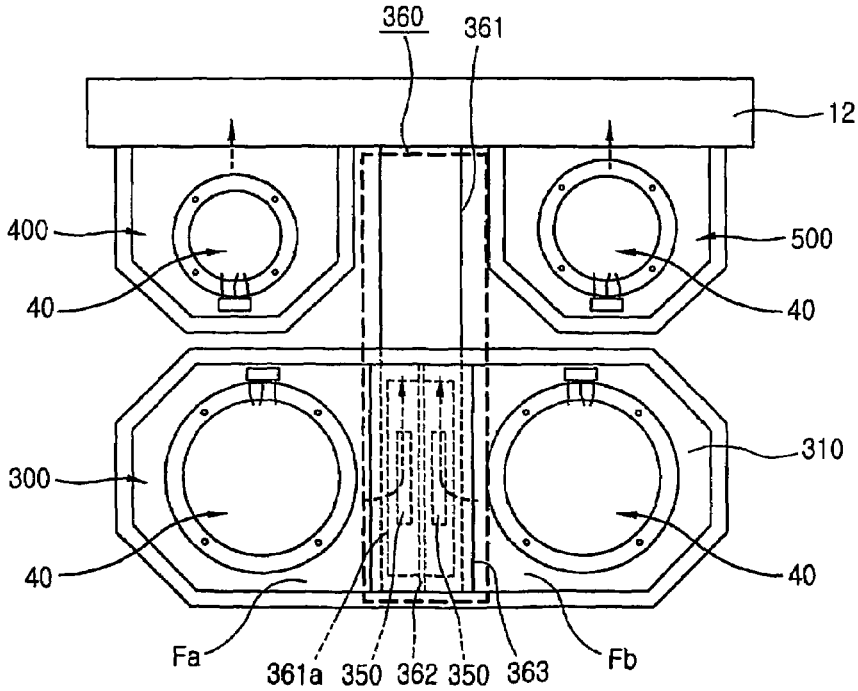
FIG. 6 is a plan view showing a first embodiment of structure of the gas radiation oven range and the cooking system in accordance with the present invention.

As shown in FIGS. 3 and 6, the first embodiment of the gas radiation oven range in accordance with the present invention includes an outer case 10 which is formed to have an internal space with the upper side opened, ceramic glass 20 which is covered and combined with the upper end of the outer case 10, for placing foodstuffs therein, a first burner housing 300 which is combined and contacted with a lower surface of the ceramic glass 20, forms an exhaust passage F with the lower surface of the ceramic glass 20, and is integrally combined with a plurality of large ports in a dual structure, a second burner housing 400 in which respective medium port is formed at a side independently from the first burner housing 300 in which the plurality of large ports are formed, and third burner housing 500 in which a small port is formed, a radiant burner 40 which is combined with a side surface of the respective burner housings 300, 400 and 500, for generating a radiant wave, combusting mixed gas and a shared discharge unit 360 which is positioned among large ports which are integrally formed in the respective first burner housings 300, combined to be connected to the respective exhaust passage F which are formed at the side portion of the large ports so that the exhaust gas, which is generated respectively from the plurality of radiant burners 40, is discharged to the exhaust duct 12 which is positioned at the rear side of the outer case 10.

In the first embodiment of the cooking system, the first burner housing 300 can be positioned at the front side of the product in which the inlet duct 11 of the outer case 10 is formed. Also, the second burner housing 400 and third burner housing 500 can be installed at the rear side of the product in which the exhaust duct 12 of the outer case 10 is formed, and vise versa.

As shown in FIG. 6, the shared discharge unit 360 includes an exhaust stack 361 which is combined to be contacted on a side surface of the first burner housing 300 and has a side surface in which a cut inflow hole 361*a* is formed, so that exhaust gas, which is discharged from a plurality of exhaust through holes 350 which are formed on one side surface of the first burner housing 300, can be received, a partition 362 which is combined with the lower plate portion 310 of the first burner housing 300 in the direction of a normal line, and respectively divides exhaust gas which is generated from a plurality of radiant burners formed on both sides of the first burner housing 300 by dividing an exhaust passage Fa of the burner housing 300*a* of a side and exhaust passage Fb of the burner housing 300*b* of the other side and an exhaust cover 363 whose upper side is positioned to be contacted on the lower substrate of the ceramic glass 20 and whose lower side is combined to the partition 362, for preventing convection heat of the exhaust gas which is generated in the radiant burner 40 from being transferred to the ceramic glass 20.

The exhaust stack 361 which is combined with the lower portion of the first burner housing 300 is extended and formed to the lower portion between the second burner housing 400 and third burner housing 500 and connected to the exhaust duct 12 which is formed at the rear surface of the outer case 10.

Also, exhaust ducts (not shown) which are respectively formed on the side surfaces of the second and third burner housings 400 and 500, are directly connected to the exhaust duct 12 which is formed on the rear surface of the outer case 10.

At the center portion of the lower plate portion 310 of the first burner housing 300, the plurality of exhaust through holes 350 which are formed corresponding to the mounting hole, are formed facing each other at the center portion of the first burner housing 300.

Hereinafter, a second embodiment of the cooking system of the gas radiation oven range in accordance with the present invention will be described.

Figure 7:
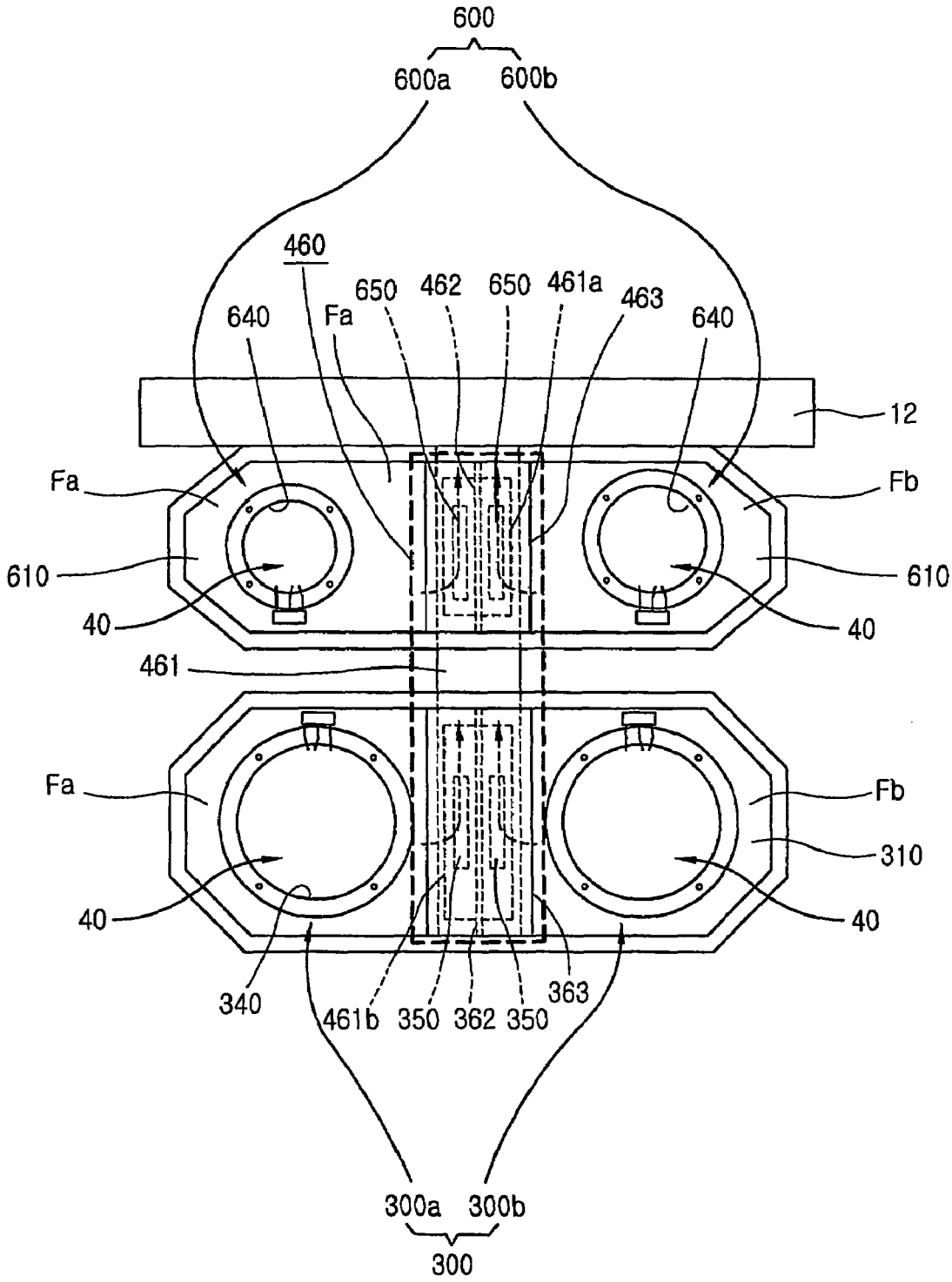
FIG. 7 is a plan view showing a second embodiment of structure of the gas radiation oven range and the cooking system in accordance with the present invention.

As shown in FIGS. 3 and 7, the second embodiment of the cooking system of the gas radiation oven range in accordance with the present invention includes an outer case 10 which is formed with an upper side opened, having an internal space, a ceramic glass 20 which is covered and combined with an upper end of the outer case 10 and in which cooked material is positioned, a first burner housing 300 which is combined and contacted with a lower surface of the ceramic glass 20, forms an exhaust passage F with the lower surface of the ceramic glass 20, and is integrally combined with a plurality of large ports in a dual structure, a fourth burner housing 600 in which a plurality of medium ports and small ports which are independent from the first burner housing 300 which is integrally formed with the plurality of large ports, a radiant burner 40 which is combined with a side surface of the respective burner housings 300 and 600, for generating a radiant wave, combusting mixed gas and a shared discharge unit 460 which is positioned among the plurality of burner housings 300 and 600 and combined to be connected to respective exhaust passages F which are formed at a side portion of the burner housings 300 and 600, for discharging exhaust gas which is generated from the plurality of radiant burners 40 respectively, to the exhaust duct 12 side which is positioned at the rear side of the outer case 10.

In the second embodiment of the cooking system, the first burner housing 300 can be positioned at the front side of the product in which the inlet duct 11 of the outer case 10 is formed. Also, the fourth burner housing 600 can be installed at the rear side of the product in which the exhaust duct 12 of the outer case 10 is formed, and vise versa.

As shown in FIG. 7, the shared discharge unit 460 includes an exhaust stack 461 which is combined to be contacted on a side surface of the first burner housing 300 and fourth burner housing 600 and has a side surface in which cut inflow holes 461*a* are formed, so that exhaust gas, which is discharged from a plurality of exhaust through holes 350 and 650 which are formed on one side surface of the first burner housing 300 and fourth burner housing 600, can be received, partitions 362 and 462 which are combined with the lower plate portions 310 and 610 of the first burner housing 300 and fourth burner housing 600 in the direction of a normal line, and respectively divides exhaust gas which is generated from a plurality of radiant burners 40 formed on both sides of the burner housing 300 and fourth burner housing 600 by dividing an exhaust passage Fa of the burner housings 300*a* and 600*a* of a side and exhaust passage Fb of the burner housings 300*b* and 600*b* of the other side, and exhaust cover 363 and 463 whose upper side is positioned to be contacted on the lower substrate of the ceramic glass 20 and whose lower side is combined to the partitions 362 and 462, for preventing convection heat of the exhaust gas which is generated in the radiant burner 40 from being transferred to the ceramic glass 20.

An exhaust stack 461 is combined with the lower portion of the first burner housing 300 and fourth burner housing 600 and shares the exhaust passage of the combustion gas and convection heat.

Also, on a side surface of the exhaust stack 461, a plurality of inflow grooves 461*a* and 461*b* are formed at the portion where the first burner housing 300 and fourth burner housing 600 are combined.

The exhaust stack 461 is connected to the exhaust duct 12 which is formed on the rear surface of the outer case 11.

The plurality of exhaust through holes 350 and 650 which are formed corresponding to the mounting holes 340 and 640, are formed to face each other at the center portions of the respective burner housings 300 and 600.

Hereinafter, a third embodiment of the cooking system of the gas radiation oven range in accordance with the present invention will be described.

Figure 8:
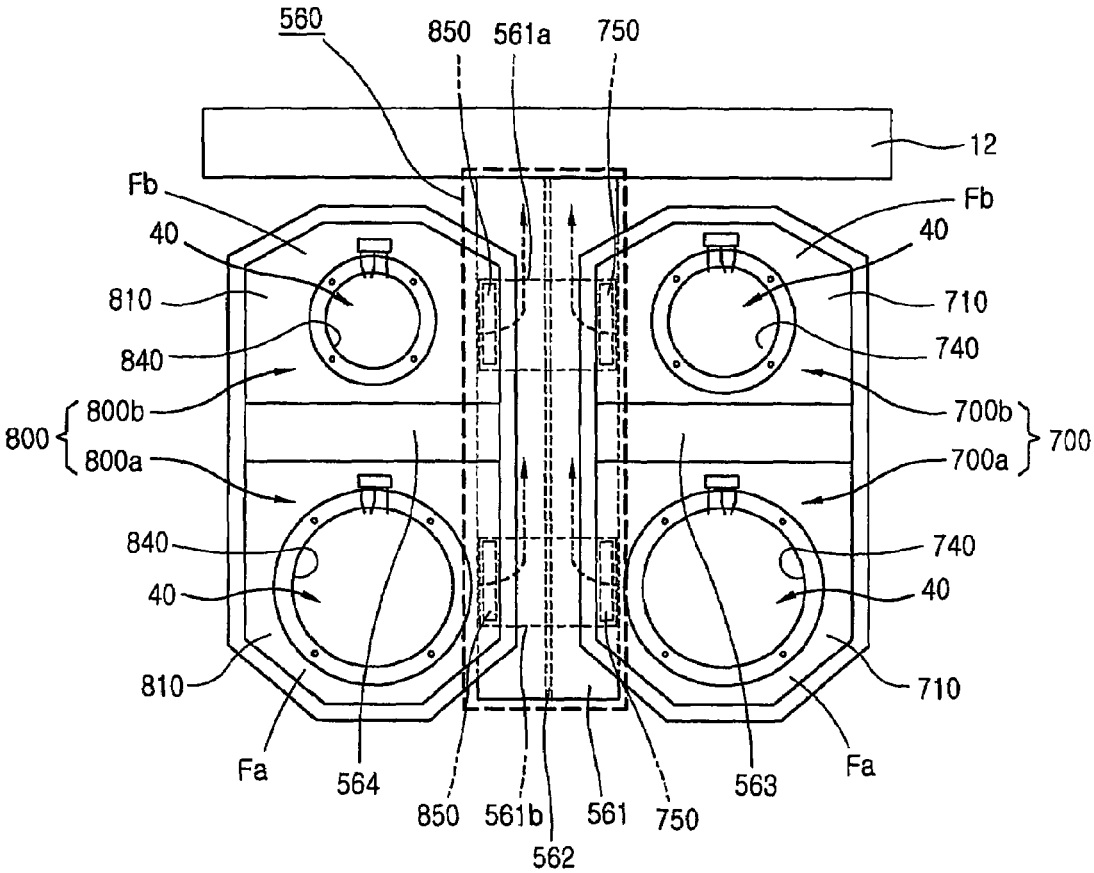
FIG. 8 is a plan view showing a third embodiment of structure of the gas radiation oven range and the cooking system in accordance with the present invention.

As shown in FIGS. 3 and 8, the third embodiment of the cooking system of the gas radiation oven range in accordance with the present invention includes an outer case 10 which is formed with an upper side opened, having an internal space, a ceramic glass 20 which is covered and combined with an upper end of the outer case 10 and in which cooked material is positioned, a fifth burner housing 700 which is combined and contacted with a lower surface of the ceramic glass 20, forms an exhaust passage F with the lower surface of the ceramic glass 20, and is integrally combined with one or more large ports and one or more medium ports in a dual structure, a sixth burner housing 800 in which one or more large ports and one or more small ports which are positioned at the side portion independently from the fifth burner housing 700, are integrally formed, a radiant burner 40 which is combined with a side surface of the fifth burner housing 700 and sixth burner housing 800 respectively, for generating a radiant wave, combusting mixed gas and a shared discharge unit 560 which is positioned among the plurality of burner housings 700 and 800, and combined to be connected to respective exhaust passages Fa and Fb which are formed at a side portion of the burner housings 700 and 800, for discharging exhaust gas which is generated from the plurality of radiant burners 40 respectively, to the exhaust duct 12 side which is positioned at the rear side of the outer case 10.

In the third embodiment of the cooking system, the fifth burner housing 700 can be positioned at the right side to the front side of the product in which an inlet duct 11 of the outer case 10 is formed. The sixth burner housing 800 can be installed at the left side to the front side of the product in which the exhaust duct 12 of the outer case 10 is formed and vice versa.

As shown in FIG. 8, the shared discharge unit 560 includes an exhaust stack 561 which is combined to be contacted on side surfaces of the fifth burner housing 700 and sixth burner housing 800 and has a side surface in which cut inflow holes 561*a* and 561*b* are formed, so that exhaust gas, which is discharged from a plurality of exhaust through holes 750 and 850 which are formed on one side surface of the fifth burner housing 700 and sixth burner housing 800, can be received, a partition wall 562 which is combined to the inner portion of the exhaust stack 561, and respectively divides exhaust gas which is generated from a plurality of radiant burners 40 formed on both sides of the fifth burner housing 700 and sixth burner housing 800 by dividing exhaust passages Fa and Fb of the fifth burner housing 700 and exhaust passages Fa and Fb of the sixth burner housing 800, and first and second exhaust covers 563 and 564 which are combined with a center portion of the fifth burner housing 700 and sixth burner housing 800 with upper sides which are positioned to be contacted on the lower substrate of the ceramic glass 20, for dividing the exhaust passages Fa and Fb of the fifth burner housing 700 and sixth burner housing 800 and preventing convection heat of the exhaust gas which is generated in the radiant burner 40 from being transferred to the ceramic glass 20.

An exhaust stack 561 is combined to a lower portion of the fifth burner housing 700 and sixth burner housing 800 and shares exhaust passages of combustion gas and convection heat.

On the other hand, at the inner center portion of the exhaust stack 561, a partition wall 562 for dividing the passage is combined being extended from the upper portion to lower portion of the inner side surface.

Also, on the side surface of the exhaust stack 561, a plurality of inflow grooves 561*a* and 561*b* are formed in a portion where the fifth burner housing 700 is combined with the sixth burner housing 800.

The exhaust stack 561 is connected to the exhaust duct 12 which is formed on a rear surface of the outer case 11.

The plurality of exhaust through holes 750 and 850 which are formed corresponding to the mounting holes 740 and 840, are formed in a side portion of the respective burner housings 700 and 800 in parallel.

Hereinafter, the operation of the structure of the burner housing of such gas radiation oven range and cooking system for the same will be described as follows.

Firstly, when the gas radiation oven range is operated after putting a cooking vessel in which cooked material is contained in the cooking region of the ceramic glass 20, external air is sucked through the air inlet duct 11 by rotation of the blast fan 46. Then, the air is supplied to the mixing gas tube 44 through the fan housing 45 and at the same time, gas which is additionally supplied, is supplied to the mixing gas tube 44 and mixed with the air. The mixed gas is discharged through the burner mat 42 and ignited and simultaneously combusted by igniting flame which is generated in the ignition and inflammation detecting unit 43.

At this time, the mixed gas is discharged through the burner mat 42 and combusted simultaneously, and the burner mat 42 radiates radiant wave by heating the burner mat 42.

The radiant wave which is radiated in the burner mat 42 penetrates the ceramic glass 20 and heats the cooking vessel (not shown) to cook the foodstuffs.

The combustion gas and convection heat which are generated as the mixing gas is combusted, flow along through the exhaust passage F which is formed by the ceramic glass 20 and burner housings 300, 600, 700 and 800 at a predetermined flowrate and discharged to the outside of the gas radiation oven range through the exhaust duct 12 which is formed on the rear surface of the outer case 10 floating inside the exhaust stacks 361, 461 and 561 by passing the inflow grooves 361*a*, 461*a*, 461*b*, 561*a* and 561*b* which are formed on a side surface of the exhaust passages 350, 650, 750 and 850 and exhaust stacks 361, 461 and 561 which are formed at the center portion of the lower plate portions 310, 610, 710 and 810 of the burner housing Also, the combustion gas and convection heat which are generated from the respective burner housings are separated by the partitions 362 and 462 and partition wall 562 so that they are not mixed.

With the present invention, the gas radiation oven range can efficiently process the exhaust gas and prevent leakage of the gas by sharing the exhaust passage and having the corresponding structure of the burner housing.

Also, the apparatus of present invention is connected with a burner housing which is composed of an exhaust stack and two or more ports and accordingly the number of the component parts can be decreased and the assembling operation can become simpler.

Also, the present invention can satisfy property of the foodstuffs and demands of cooking industries for simultaneously cooking various foods.

At the present invention may be embodied in several forms without departing from the spirit or essential characteristics thereof, if should also be understood that the above-described embodiments are not limited by any of the details of the foregoing description, unless otherwise specified, but rather should be constructed broadly within its spirit and scope as defined in the appended claims, and therefore all changes and modifications that fall within the meets and bounds of the claims, or equivalence of such meets and bounds are therefore intended to be embraced by appended claims.

The invention claimed is:

1. A gas radiation oven range, comprising:

an outer case, an upper side of the outer case being opened;

a ceramic glass at the upper side of the outer case;

a burner housing which is in contact with a lower surface of the ceramic glass and forms a plurality of exhaust passages together with the lower surface of the ceramic glass, the burner housing having a plurality of exhaust through holes;

a plurality of radiant burners in the burner housing to generate a radiant wave, combusting mixed gas; and a shared discharge unit extending to the rear surface of the outer case so that exhaust gas generated respectively from the plurality of radiant burners is discharged to an exhaust duct which is positioned at the rear side of the outer case, the shared discharge unit being positioned among the plurality of radiant burners and connected with the respective exhaust passages which are formed in a side portion of the burner housing, the plurality of exhaust through holes of the burner housing facing a bottom plate of the shared discharge unit, wherein the burner housing includes:

a lower plate portion, the exhaust through holes being located at the lower plate portion;

a side plate portion which is formed bent and extended in the vertical direction corresponding to a contour of the lower plate portion along the circumference on the side surface of the lower plate portion;

a combining surface portion formed extended and bent in parallel in the direction of the outer circumference from the end of the side plate portion having a predetermined area; and a plurality of mounting holes which are penetrated and formed on both sides of the lower plate portion so that the radiant burner can be mounted, wherein the plurality of exhaust through holes are located directly above the bottom plate of the shared discharge unit, wherein the plurality of exhaust through holes are formed in parallel in a row in the side portion of the burner housing, and wherein the shared discharge unit includes:

an exhaust stack having a top surface in contact with a side surface of the burner housing, the exhaust through holes being located at the side surface of the burner housing, a cut inflow hole being located at the top surface of the exhaust stack and directly facing the exhaust through holes, so that the exhaust gas pass through the cut inflow hole into the exhaust stack via the exhaust through holes;

a partition wall located on the burner housing to divide the exhaust through holes into two groups, the two groups of the exhaust through holes are located substantially symmetrically with respect to the wall such that the exhaust gas on one side of the partition wall is isolated from the exhaust gas on the other side of the partition wall before the exhaust gas enters into the exhaust stack; and an exhaust cover whose upper side is positioned to be contacted on a lower substrate of the ceramic glass and whose lower side is combined to the partition, for preventing convection heat of the exhaust gas which is generated in the radiant burner from being transferred to the ceramic glass.

2. A gas radiation oven range, comprising:

an outer case which is formed with an upper side opened;

a ceramic glass covering the upper side of the outer case;

a first burner housing which is in contact with a lower surface of the ceramic glass, forms a plurality of exhaust passages with the lower surface of the ceramic glass, and is integrally combined with a plurality of large ports in a dual structure, the first burner housing having a plurality of exhaust through holes;

a second burner housing with a medium port independently from the first burner housing;

a third burner housing with a small port;

a plurality of radiant burners, each of which is located in a respective one of the burner housings, for generating a radiant wave, combusting mixed gas; and a shared discharge unit which is positioned among the plurality of large ports which are integrally formed with the first burner housing and is connected to the exhaust passages which are formed at a side portion of the large ports, for discharging exhaust gas which is generated from the radiant burners in the first burner housing, to an exhaust duct which is positioned at the rear side of the outer case, the plurality of exhaust through holes of the first burner housing facing a bottom plate of the shared discharge unit, wherein the first burner housing is positioned on a front side of the range in which an inlet duct of the outer case is formed and the second burner housing and the third burner housing are positioned on a rear side of the range on which the exhaust duct of the outer case is formed, wherein exhaust ducts of the second burner housing and third burner housing are directly connected to the exhaust duct which is formed on the rear surface of the outer case, wherein the shared discharge unit includes an exhaust stack having a top surface in contact with a side surface of the first burner housing, the exhaust through holes being located at the side surface of the first burner housing, a cut inflow hole being located at the top surface of the exhaust stack and directly facing the exhaust through holes, so that the exhaust gas pass through the cut inflow hole into the exhaust stack via the exhaust through holes, and wherein the exhaust through holes are located between two immediate adjacent radiant burners in the first burner housing wherein the shared discharge unit includes a partition wall located on the first burner housing to divide the exhaust through holes into two groups, the two groups of the exhaust through holes are located substantially symmetrically with respect to the partition wall such that the exhaust gas on one side of the partition wall is isolated from the exhaust gas on the other side of the partition wall before the exhaust gas enters into the exhaust stack.

3. A gas radiation oven range, comprising:

an outer case which is formed with an upper side opened;

a ceramic glass covering the upper side of the outer case;

a first burner housing which is in contact with a lower surface of the ceramic glass, forms a plurality of exhaust passages with the lower surface of the ceramic glass, and is integrally combined with a plurality of large ports in a dual structure, the first burner housing having a plurality of exhaust through holes;

a second burner housing in which at least one medium port and at least one small port which are independent from the first burner housing, the second burner housing forming a plurality of exhaust passages with the lower surface of the ceramic glass;

a plurality of radiant burners, each of which is located in a respective one of the burner housings, for generating a radiant wave, combusting mixed gas; and a shared discharge unit which is positioned between the burner housings and connected to the exhaust passages of the first and second burner housings, for discharging exhaust gas which is generated from the plurality of radiant burners respectively, to an exhaust duct which is positioned at the rear side of the outer case, the plurality of exhaust through holes of the first burner housing facing a bottom plate of the shared discharge unit, wherein the first burner housing is positioned on a front side of the range in which an inlet duct of the outer case is formed, and the second burner housing is positioned on the front side of the range in which the inlet duct of the outer case is formed, or wherein the first burner housing is positioned on a rear side of the range in which the exhaust duct of the outer case is formed, and the second burner housing is positioned on the front side of the range in which the inlet duct of the outer case is formed, wherein the first burner housing and the second burner housing share an exhaust stack for discharging the exhaust gas which is generated inside the first and second burner housings, wherein a plurality of inflow grooves are formed on a surface of the exhaust stack, wherein the shared exhaust stack is connected with the exhaust duct which is formed on the rear surface of the outer case, and wherein the shared discharge unit includes:

an exhaust stack having a top surface in contact with a side surface of the first burner housing, the exhaust through holes being located at the side surface of the first burner housing, a cut inflow hole being located at the top surface of the exhaust stack and directly facing the exhaust through holes, so that the exhaust gas passes through the cut inflow hole into the exhaust stack via the exhaust through holes; and a partition wall located on the first burner housing to divide the exhaust through holes into two groups, the two groups of the exhaust through holes are located substantially symmetrically with respect to the partition wall such that the exhaust gas on one side of the partition wall is isolated from the exhaust gas on the other side of the partition wall before the exhaust gas enters into the exhaust stack.

4. A gas radiation oven range, comprising:

an outer case which is formed with an upper side opened;

a ceramic glass covering the upper side of the outer case;

a first burner housing which is in contact with a lower surface of the ceramic glass, forms a plurality of exhaust passages with the lower surface of the ceramic glass, and is integrally combined with one or more large ports and one or more medium ports in a dual structure, the first burner housing having a plurality of exhaust through holes;

a second burner housing in which one or more large ports and one or more small ports which are positioned at the side portion independently from the first burner housing, are integrally formed, the second burner housing forming a plurality of exhaust passages with the lower surface of the ceramic glass;

a plurality of radiant burners, each of which is located in one of the first and second burner housings, for generating a radiant wave, combusting mixed gas; and a shared discharge unit which is positioned between the first and second burner housings and connected to the exhaust passages of the first and second burner housings, for discharging exhaust gas which is generated from the plurality of radiant burners respectively, to an exhaust duct which is positioned at the rear side of the outer case, the plurality of exhaust through holes of the first burner housing facing a bottom plate of the shared discharge unit, wherein the first burner housing and the second burner housing share an exhaust stack for discharging the exhaust gas, wherein a plurality of inflow grooves are formed on a surface of the exhaust stack, wherein the exhaust stack for sharing is connected with the exhaust duct which is formed on the rear surface of the outer case, and wherein the shared discharge unit includes:

an exhaust stack having a top surface in contact with a side surface of the first burner housing, the exhaust through holes being located at the side surface of the first burner housing, a cut inflow hole being located at the top surface of the exhaust stack and directly facing the exhaust through holes, so that the exhaust gas pass through the cut inflow hole into the exhaust stack via the exhaust through holes; and a partition wall located on the first burner housing to divide the exhaust through holes into two groups, the two groups of the exhaust through holes are located substantially symmetrically with respect to the partition wall such that the exhaust gas on one side of the partition wall is isolated from the exhaust gas on the other side of the partition wall before the exhaust gas enters into the exhaust stack.

5. The gas radiation oven range of claim 4, wherein the first burner housing is positioned at a right side of a front side of the range in which an inlet duct of the outer case is formed, and the second burner housing is positioned at a left side of the front side of the range in which the inlet duct of the outer case is formed.

6. The gas radiation oven range of claim 4, wherein the first burner housing is positioned at a left side of a front side of the range in which an inlet duct of the outer case is formed, and the second burner housing is positioned at a right side of the front side of the range in which the inlet duct of the outer case is formed.

7. A gas radiation oven range, comprising:

an outer case which is formed with an upper side opened;

a ceramic glass covering the upper side of the outer case;

a plurality of burner housings, each of which is in contact with a lower surface of the ceramic glass, forms an exhaust passage with the lower surface of the ceramic glass, and is integrally combined with a port, each of the burner housings having at least one exhaust through hole;

a plurality of radiant burners, each of which is located in a respective one of the burner housings, for generating a radiant wave, combusting mixed gas; and a shared discharge unit which is positioned among the burner housings and connected to the respective exhaust passages, for discharging exhaust gas which is generated from the plurality of radiant burners respectively, to an exhaust duct which is positioned at the rear side of the outer case, the at least one exhaust through hole of each of the plurality of burner housings facing a bottom plate of the shared discharge unit, wherein the shared discharge unit includes:

an exhaust stack having a top surface in contact with a side surface of the burner housings, the exhaust through holes being located at the side surface of the burner housings, at least one cut inflow hole being located at the top surface of the exhaust stack and directly facing the exhaust through holes, so that the exhaust gas pass through the cut inflow hole into the exhaust stack via the exhaust through holes; and a partition wall located among the burner housings to divide the exhaust through holes into two groups, the two groups of the exhaust through holes are located substantially symmetrically with respect to the partition wall such that the exhaust gas on one side of the partition wall is isolated from the exhaust gas on the other side of the partition wall before the exhaust gas enters into the exhaust stack.

8. A gas radiation oven range comprising:

a ceramic cook top having a front end and a rear end;

an exhaust duct located at the rear end of the ceramic cook top;

a set of rear burners near the rear end of the ceramic cook top, each rear burner having a corresponding exhaust slot;

a set of front burners near the front end of the ceramic cook top, each front burner having a corresponding exhaust slot;

an exhaust stack located below and between the front burners to provide a combined exhaust path from the exhaust slots to the exhaust duct to allow discharge of combustion gas, wherein the exhaust slots of the front burners extend in a parallel manner towards the exhaust duct and face into the exhaust stack in a downward direction away from the ceramic cook top, and wherein the front burners are housed together to allow the combined exhaust path from the exhaust slots of the front burners to the exhaust duct;

a cover located above the exhaust slots of the front burners and having inlets that facilitate combustion gas to flow into the exhaust stack via the exhaust slots; and a blast fan device located adjacent to and in communication with at least one burner, the blast fan device providing air into the burner and allowing combustion gas to pass into the exhaust stack via the exhaust slots and out the exhaust duct.

9. The gas radiation oven range of claim 8, wherein the exhaust slot of each rear burner faces directly into the exhaust duct.

10. The gas radiation oven range of claim 8, wherein the exhaust slot of each rear burner faces into the exhaust stack in a downward direction away from the ceramic cook top, and the exhaust slot of each rear burner is connected to the exhaust duct via the exhaust stack.

* * * * *